United States Patent [19]

Sugita et al.

[11] Patent Number: 4,487,235

[45] Date of Patent: Dec. 11, 1984

[54] METHOD OF AND APPARATUS FOR DETECTING WEFT YARN IN JET LOOMS

[75] Inventors: Katsuhiko Sugita; Tsutomu Sainen, both of Kanazawa, Japan

[73] Assignee: Tsudakoma Corp., Ishikawa, Japan

[21] Appl. No.: 497,524

[22] Filed: May 24, 1983

[30] Foreign Application Priority Data

May 31, 1982 [JP] Japan ..... 57-092467

[51] Int. Cl.[3] ..... D03D 51/18

[52] U.S. Cl. ..... 139/370.2; 340/677

[58] Field of Search ..... 139/370.2, 370.1, 435; 340/677; 66/163; 57/81; 112/278

[56] References Cited

U.S. PATENT DOCUMENTS

| | | | |
|---|---|---|---|
| 3,967,656 | 7/1976 | Gotoh | 139/370.2 |
| 4,183,381 | 1/1980 | Gotoh | 139/370.1 |
| 4,188,902 | 2/1980 | Kahan | 112/278 |
| 4,270,579 | 6/1981 | Nakanishi | 139/370.2 |
| 4,393,903 | 7/1983 | Ida | 139/370.2 |

FOREIGN PATENT DOCUMENTS

| | | | |
|---|---|---|---|
| 2156614 | 5/1973 | Fed. Rep. of Germany | 66/163 |

*Primary Examiner*—James Kee Chi

*Attorney, Agent, or Firm*—Flynn, Thiel, Boutell & Tanis

[57] ABSTRACT

The amplitude of a signal (original waveform) produced by weft sensors is relativized, and the signal waveform is analyzed in various aspects based on multiple parameters to discriminate a weft yarn and a jet of fluid accurately. More specifically, a discriminating function is calculated beforehand from a signal indicative of the weft yarn and jet of fluid under normal weft insertion conditions, and a signal produced in actual detection operation is compared with the discriminating function to determine whether the weft yarn is present or not. The discriminating function can be obtained by extracting feature parameters from a signal generated by the weft sensors, and relativizing the feature parameters with respect to the original signal waveform to find a reference quantity. The feature parameters include the original waveform per se, a differentiated value thereof, an integrated value thereof, frequencies in certain frequency ranges, and sampling averages of the above parameters. The parameter relativization is carried out by finding ratios and differences between the feature parameters. The discriminating function is created by a statistical method.

17 Claims, 5 Drawing Figures

METHOD OF AND APPARATUS FOR DETECTING WEFT YARN IN JET LOOMS

BACKGROUND OF THE INVENTION

The present invention relates to a method of and an apparatus for detecting weft yarn insertion in a jet loom such as a water jet loom or an air jet loom.

Water jet looms or air jet looms, also called shuttleless looms, utilize a jet of water or air to carry the weft yarn through the shed. The jet looms include a weft stop device for automatically stopping operation of the loom in response to detection of a weft insertion failure.

The weft yarn as inserted by a water jet is normally detected by a weft feeler in the form of an electrode, and the weft yarn as carried by an air jet is normally detected by a photoelectric feeler. FIG. 1 of the accompanying drawings illustrates the original waveform of a signal A generated by such a weft yarn detector associated with a water jet loom, the signal A being plotted in one cycle of principal motion of the loom. The illustrated motion cycle is composed of an internal I in which there is no signal generated, an interval II in which only a jet of water is ejected, an interval III in which atomized water and a weft yarn are present, an internal IV in which only the weft yarn is present in the shed, and an interval V in which the inserted weft yarn is beaten up by a reed. The waveform of the signal A or the signal portion in the interval IV is identified to detect whether there is a weft yarn length inserted through the shed. More specifically, the conventional weft yarn detecting apparatus detects weft yarn insertion by calculating the proportion of a portion of the signal A which exceeds a certain threshold in an interval, or comparing an integrated or differentiated value of a signal portion in an interval with a threshold.

Where amplifiers for amplifying such a signal are DC-coupled with each other, however, a signal produced due to deteriorated insulation is also amplified by the amplifiers, resulting in difficulty in achieving correct weft insertion determination. Where the amplifiers are AC-coupled with each other to avoid this difficulty, the signal portion in the interval IV tends to go negative with a weft yarn having a low moisture content. No matter how the amplifiers are coupled, the time when the interval IV starts after the interval III varies at all times. This makes it difficult to effect reliable determination of weft insertion in the interval IV based on the signal waveform under the influence of large signal irregularities in the interval II. The threshold against which the signal A is to be compared is not absolute, but varies relative to the signal. With comparison between a simply processed signal waveform and a threshold, therefore, it has been impossible to detect weft yarns correctly, and weft detection failures and unnecessary loom shutdown have been caused frequently.

SUMMARY OF THE INVENTION

It is an object of the present invention to provide a method of correctly and reliably detecting a weft yarn in a jet loom.

Another object of the present invention is to provide an apparatus for correctly and reliably detecting a weft yarn in a jet loom.

According to the present invention, the amplitude of a signal (original waveform) produced by weft feelers is relativized, and the signal waveform is analyzed in various aspects based on multiple parameters to discriminate a weft yarn and a jet of fluid accurately. More specifically, a discriminating function is calculated beforehand from a signal indicative of the weft yarn and jet of fluid under normal weft insertion condition, and a signal produced in actual detection operation is compared with the discriminating function to determine whether the weft yarn is present or not. The discriminating function can be obtained by extracting feature parameters from a signal generated by the weft feelers, and relativizing the feature parameters with respect to the original signal waveform to find a reference quantity. The feature parameters include the original waveform per se, a differentiated value thereof, an integrated value thereof, frequencies in certain frequency ranges, and sampling averages of the above parameters. The parameter relativization is carried out by finding ratios and differences between the feature parameters. The discriminating function is created by a statistic method.

The above and other objects, features and advantages of the present invention will become more apparent from the following description when taken in conjunction with the accompanying drawings in which preferred embodiments of the present invention are shown by way of illustrative example.

DETAILED DESCRIPTION

The present invention will be described with reference to embodiments thereof in which the principles of the invention are incorporated in a water jet loom.

Figure 1:
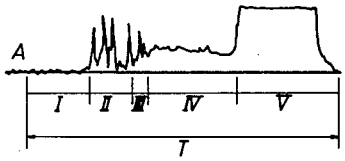
FIG. 1 is a diagram showing the waveform of an original signal detected on weft insertion.
Figure 3:
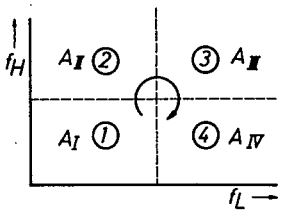
FIG. 3 is a diagram showing frequency ranges to which detected signal fractions belong, respectively.
Figure 2:
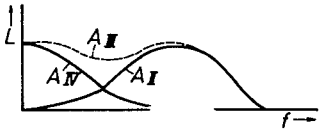
FIG. 2 is a graph illustrating frequency characteristics of a detected signal.

As shown in FIG. 1, the original waveform of a signal A generated on weft insertion varies widely on a time base, and has different frequencies in the intervals II, III and IV. FIG. 2 is illustrative of frequency characteristics of the signal A with the horizontal axis indicating a frequency f and the vertical axis a signal level L. A signal fraction $A_{II}$ detected in the interval II when only water is present in the shed has a peak in a high frequency range, while a signal fraction $A_{IV}$ detected in the interval IV when only weft yarn is inserted through the shed has a peak lower than the peak of the signal fraction $A_{II}$. When both water and weft yarn are present in the shed of the transient interval III, a signal fraction $A_{III}$ is the sum of the signal fractions $A_{II}$ and $A_{IV}$. FIG. 3 shows successive frequency ranges followed by the signal A with time, the horizontal axis being indicative of low frequencies $f_L$ and the vertical axis of high frequencies $f_H$ with broken lines showing thresholds. More specifically, the signal A is considered to change in frequency from the range 1 to the range 2 to the range 3 to the range 4 as time goes on.

Figure 4:
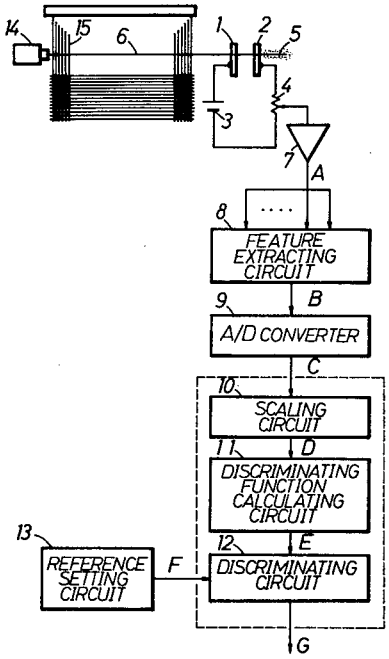
FIG. 4 is a block diagram of an apparatus for detecting a weft yarn in a jet loom according to an embodiment of the present invention.

As shown in FIG. 4, a weft yarn 6 to be detected is inserted by a jet of water 5 ejected from a weft insertion nozzle 14 through a warp shed across warp threads 15.

A pair of weft feelers or sensors 1, 2 in the form of two electrodes is positioned remotely from the nozzle 14 for generating a signal A. The weft feelers 1, 2 are spaced a distance from each other along a straight line aligned with a path in which the weft yarn 6 is inserted through the shed. The weft feelers 1, 2 are connected to a power supply 3 and a rheostat 4 to constitute a closed circuit for generating a signal A based on conductivities of the jet of water 5 and the weft yarn 6 and having a waveform indicative of whether the jet of water 5 and the weft yarn 6 are inserted. The signal A produced by the weft feelers 1, 2 is then adjusted in level by the rheostat 4 and amplified by an amplifier 7. The amplified signal is delivered to a feature extracting circuit 8, which produces a signal B indicative of the following characteristic parameters or feature parameters X of the original waveform of the signal A:

(1) original waveform $X_1$;
(2) differentiated value $X_2$ of the original waveform;
(3) integrated value $X_3$ of the original waveform;
(4) output $X_4$ from a high-pass filter to which the original waveform is applied;
(5) output $X_5$ from a low-pass filter to which the original waveform is applied;
(6) sampling average $X_6$ of the original waveform;
(7) sampling average $X_7$ of the differentiated value $X_2$ or the high-pass filter output $X_4$; and
(8) sampling average $X_8$ of the integrated value $X_3$ or the low-pass filter output $X_5$.

The feature signal B indicates any one of the feature parameters $X_1$ to $X_8$. The feature extracting circuit 8 is therefore composed of a differentiating circuit, an integrating circuit, a high-pass filter, a low-pass filter and a sampling circuit.

The feature signal B is fed to an A/D converter 9 which converts the analog feature signal B into a digital signal C. The A/D conversion process is required to allow subsequent digital signal processing. The digital signal C is then supplied to a scaling circuit 10 in which the amplitude of the digital signal C corresponding to the feature signal B is relativized or normalized with respect to the original waveform of the signal A to provide a standard signal D corresponding to a reference quantity. The amplitude relativization is carried out through arithmetic operations to find the following quantities:

(1) ratio of the feature parameters to the original waveform $X_1$ $$X_2/X_1,\ X_3/X_1,\ X_4/X_1,\ X_5/X_1,\ \text{etc.};$$

(2) difference between the feature parameters and the sampling average $X_{6(I)}$ of the signal fraction $A_I$ $$X_2-X_{6(I)},\ X_3-X_{6(I)},\ X_4-X_{6(I)},\ X_5-X_{6(I)},\ X_7-X_{6(I)},\ X_8-X_{6(I)},\ \text{etc.};$$

(3) ratio of the feature parameters to the sampling average $X_6$ of the original waveform $X_1$ $$X_2/X_6,\ X_3/X_6,\ X_4/X_6,\ X_5/X_6,\ X_7/X_6,\ X_8/X_6,\ \text{etc.};$$

and (4) combinations of the above items (1), (2) and (3).

The standard signal D thus obtained has a waveform that has been relativized with respect to the signal level of the original waveform of the signal A or the amplitude of the original waveform.

The standard signal D is then delivered from the scaling circuit 10 to a circuit 11 for computing a discriminating function. The circuit 11 is responsive to the standard signal D for calculating a discriminating signal E of a discriminating function serving to determine whether there is a weft yarn 6 at times. The discriminating function signal E is compared by a discriminating circuit 12 with a reference signal F fed from a reference setting circuit 13 for producing a comparison signal indicative of whether there is a weft yarn 6 or not in the shed. The following methods are available for calculating the discriminating function and determining whether there is a weft yarn inserted:

(1) The discriminating function is calculated from the sampling average ratio ($X_7/X_8$) at times, the discriminating function signal E is compared with reference signal F for theshold processing to compare the number of insertion occurrences with a reference occurrence number, and finally the presence or absence of the weft yarn 6 is determined;

(2) The discriminating function signal E is determined by effecting threshold processing for two or more feature parameters at each time, and the discriminating function signal E is compared with the reference signal F in each frequency range to find which frequency range 1, 2, 3 or 4 (FIG. 3) the signal E falls in;

(3) Discriminating functions are statistically created by taking into account an occurrence probability based on a distribution pattern of feature parameters X of any one kind when there is a weft yarn and when there is no weft yarn, and the presence of the weft yarn 6 in the shed is checked from the score of the discriminating function;

(4) The original waveform $X_1$ or its sampling average $X_6$ in the interval IV is subjected to threshold processing to determine whether there is a weft yarn. The interval III in which the signal varies largely and the interval IV in which the signal varies less largely are differentiated from the equation of variation $$dt = \sum_{i=1}^{n} | X_{it} - X_{it-1} |$$

at each time t. When the change dt is large, the interval is II or III, and when the change dt is small, the interval is IV;

(5) The change dt is measured at each time interval such as every loom crank angle change of 5° or every 10 ms. When the number of large changes exceeds a certain number, e.g., the reference given by the reference signal F, the interval is judged as II or III. Thus, the intervals II, III can be differentiated from the interval IV; and (6) The processes (1), (2) and (3) are applied to the change dt as determined by the processes (4) and (5).

The reference signal F may be experimentally set and programmed in advance, or entered from an external source.

As a result of the foregoing determination, the discrimating circuit 12 generates a stop signal G which is utilized to stop operation of the loom, generate an alarm signal, and command other necessary operations.

Since the above scaling operation, calculation of the discriminating function, and determination can all be digitally processed, the series of operations can efficiently be performed by a CPU (Central Processing Unit). The portion of the circuit enclosed by the broken line in FIG. 4 can thus be constructed as part of such a CPU.

Figure 5:
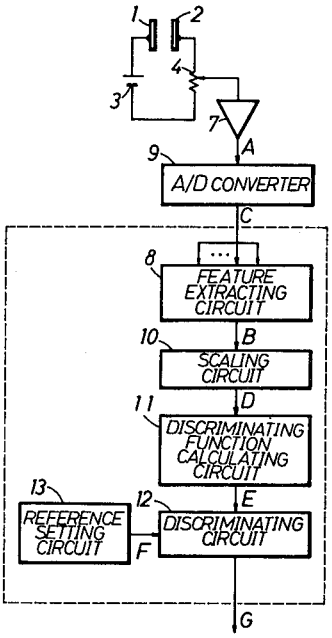
FIG. 5 is a block diagram of an apparatus for detecting a weft yarn in a jet loom according to another embodiment of the present invention.

FIG. 5 shows in block form an apparatus according to another embodiment, in which an output from the amplifier 7 is directly supplied to the A/D converter 9, and an output from the A/D converter 9 is then subjected to feature extraction. Since in this embodiment digital quantities are available for a series of operations from the feature extraction to the determination, such operations can be software-implemented in a CPU as indicated by the broken line in FIG. 5.

With the arrangement of the present invention, the waveform of a signal detected by the weft feelers 1, 2 is relativized for protection against malfunctioning due to noise. The signal waveform is analyzed in various aspects based on multiple feature parameters extracted from the original waveform for discriminating a weft yarn and a jet of water, with the result that the presence of a weft yarn inserted through the shed can be correctly and reliably detected.

While in the foregoing description the present invention has been described as being incorporated in a water jet loom for carrying a weft yarn on a jet of water, the invention is also applicable to an air jet loom for detecting a weft yarn inserted by a jet of air since fly waste behaves like a jet of water. In such an alternative, the electrode weft feelers 1, 2 are replaced with a pair of photoelectric feelers.

Although certain preferred embodiments have been shown and described, it should be understood that many changes and modifications may be made therein without departing from the scope of the appended claims.

The embodiments of the invention in which an exclusive property or privilege is claimed are defined as follows:

1. A method of detecting a weft yarn inserted through a warp shed in a jet loom by a jet of fluid, comprising the steps of:

(a) providing sensor means responsive to the presence of a weft yarn and responsive to the presence of a jet of fluid in the warp shed for producing a signal;

(b) extracting from said signal plural characteristic parameters thereof, including characteristic parameters representative of frequency components generated by a weft yarn and by a jet of fluid;

(c) calculating normalized signals from said characteristic parameters;

(d) calculating a discriminating function from a combination of said normalized signals; and (e) comparing said discriminating function with a reference signal.

2. The method according to claim 1, wherein one of said characteristic parameters is a differentiation of the original waveform of said signal.

3. The method according to claim 1, wherein one of said characteristic parameters is an integration of the original waveform of said signal.

4. The method according to claim 1, wherein one of said characteristic parameters is an output from a high-pass filter having a input to which the original waveform of said signal is applied.

5. The method according to claim 1, wherein one of said characteristic parameters is an output from a low-pass filter having an input to which the original waveform of said signal is applied.

6. The method according to claim 1, wherein one of said characteristic parameters is a sampling average of the original waveform of said signal.

7. The method according to claim 1, wherein one of said characteristic parameters is a sampling average of an integration of the original waveform of said signal.

8. The method according to claim 1, wherein one of said characteristic parameters is a sampling average of an output from a high-pass filter having an input to which the original waveform of said signal is applied.

9. The method according to claim 1, wherein one of said characteristic parameters is a sampling average of a differentiation of the original waveform of said signal.

10. The method according to claim 1, wherein one of said characteristic parameters is a sampling average of an output from a low-pass filter having an input to which the original waveform of said signal is applied.

11. The method according to claim 1, wherein a first of said characteristic parameters is an output from a low-pass filter having an input to which the original waveform of said signal is applied; wherein a second of said characteristic parameters is an output of a high-pass filter having an input to which the original waveform of said signal is applied; and wherein said steps of calculating a discriminating function and comparing it with said reference signal include evaluation of said first and second characteristic parameters for the presence and relative amplitudes of low and high frequency signal components in said signal produced by said sensor means.

12. An apparatus for detecting a weft yarn inserted by a jet of fluid through a warp shed in a jet loom, comprising:

(a) nozzle means for ejecting a jet of fluid to insert a weft yarn through said warp shed;

(b) a pair of spaced sensors provided on a side of said warp shed opposite from said nozzle means and means responsive to said sensors for producing an electric signal;

(c) amplifier means for amplifying said electric signal;

(d) extracting means responsive to said amplifier means for extracting from said electric signal plural characteristic parameters thereof, including characteristic parameters respresentative of frequency components generated by a weft yarn and by a jet of fluid;

(e) scaling means responsive to said extracting means for normalizing amplitudes of said characteristic parameters;

(f) discriminating function calculating means responsive to said scaling means for calculating a discriminating function from a combination of said normalized characteristic parameters;

(g) reference setting means for providing a predetermined reference; and (h) discriminating means responsive to said reference setting means and to said discriminating function calculating means for comparing said discriminating function derived from said electric signal to said predetermined reference, and for producing an output signal in response to said comparison which indicates whether a weft yarn is present in the region of said electrodes.

13. The apparatus according to claim 12, wherein said extracting means includes analog to digital converter means coupled to said scaling means for digitalizing said characteristic parameters provided to said scaling means.

14. The apparatus according to claim 13, including a central processing unit responsive to said analog to digital converter means and said reference setting means, wherein said scaling means, said discriminating function calculating means, and said discriminating means are implemented in said central processing unit.

15. The apparatus according to claim 12, wherein said amplifier means includes analog to digital converter means coupled to said extracting means for digitizing said electric signal provided to said extracting means.

16. The apparatus according to claim 15, including a central processing unit responsive to said analog to digital converter means and said reference setting means, said extracting means, said scaling means, said discriminating function calculating means and said discriminating means being implemented in said central processing unit.

17. The apparatus according to claim 12, wherein said sensors are each an electrode, and wherein said means responsive to said sensors includes a power source and a rheostat connected in series with each other between said electrodes, said amplifier means being operatively coupled to a wiper of said rheostat.

* * * * *